United States Patent [19]

Hartung et al.

[11] 4,252,073

[45] Feb. 24, 1981

[54] CONTAINER-BOAT FENDER

[76] Inventors: Philip F. Hartung, 655 Main St., East Greenwich, R.I. 02818; John J. Tramonti, 142 Smith St., Warwick, R.I. 02886

[21] Appl. No.: 10,119

[22] Filed: Feb. 7, 1979

[51] Int. Cl.[3] ..... B63B 59/02

[52] U.S. Cl. ..... 114/219; 215/1 C

[58] Field of Search ..... 215/1 C, 1 R, 100 R, 215/365; 114/219, 267; 9/8 R; 43/44.87, 44.9

[56] References Cited

U.S. PATENT DOCUMENTS

| | | | |
|---|---|---|---|
| 2,140,724 | 12/1938 | Stefan | 43/44.9 |
| 3,145,686 | 8/1964 | Blythe | 114/219 |
| 3,183,875 | 5/1965 | Russell | 114/219 |

*Primary Examiner*—Trygve M. Blix
*Assistant Examiner*—D. W. Keen
*Attorney, Agent, or Firm*—Caesar, Rivise, Bernstein & Cohen, Ltd.

[57] ABSTRACT

A bottle and boat fender comprising a hollow body for holding a flowable material therein. The body includes a top wall portion having an opening communicating with the interior of the body, a threaded cap covering the opening, a bottom wall portion and a side wall portion disposed between the top wall portion and the bottom wall portion. The side wall forms the periphery of the body and includes two pairs of planar opposed wall portions. Each of the wall portions of one pair include a pair of conical depressions therein which are aligned with a pair of conical depressions in the the opposed wall portion. The bottom of the aligned opposed depressions forms a common wall therebetween which includes an aperture of sufficient size to accomodate nautical rope therethrough. One aperture is located below the top wall and the other aperture is located above the bottom wall.

5 Claims, 6 Drawing Figures

PRIOR ART

CONTAINER-BOAT FENDER

This invention relates generally to containers and, more particularly, to bottles.

Most liquids sold today are packaged in either cans, jars or bottles. After the contents of such containers are used up the containers are normally discarded as refuse. In the interest of ecology, some containers e.g., glass bottles, aluminium cans, etc., are recycled, but such action is not widespread. In the interest of ecology some interprising persons have saved containers making use of them for various purposes unrelated to storage. For example, jug-type containers, like plastic milk jugs, have been used as boat bumpers or fenders by looping nautical line through the handle and hanging the jug over the gunwale of the boat. Such an arrangement, while laudable from an ecology standpoint, leaves much to be desired from the standpoint of effectiveness in protecting the boat. The limited effectiveness of the use of a plastic jug as a boat fender is due to the fact that the shape of the jug, e.g., the large aperture handle, causes the jug to hang below the boat's gunwale and not immediately opposite thereto, which position is necessary to prevent impact damage from an adjacent boat or static structure.

In the U.S. Pat. No. 3,145,686 (Blythe) there is disclosed a boat bumper which may also serve as a storage container in order to save valuable space on a boat. The bumper comprises a hollow, right circular cylinder body portion having an opposed pair of flat end walls. A hollow, threaded nipple projects outward from one side wall and communicates with the interior of the body portion to serve as a mouth for pouring material into or out of the body portion. A threaded cap is screwed into engagement on the nipple. A thin, planar flange projects outward normally from each end wall. Each flange includes an opening therein adjacent its free end and arranged to receive a rope or other suitable line to hang the bumper from the boat.

The provision of the projecting flanges in the Blythe patent renders the container unsuitable for merchandising applications since their location precludes vertical disposition or storage of the container on one of its end walls. Moreover, the openings in the flanges are located well beyond the cylindrical body portion of the bumper so that when the bumper is hung on the boat the thin flange is located opposite the gunwale while the body portion hangs substantially therebelow. This disposition renders the boat susceptible to damage by impact from another at the gunwale.

While some bumpers or boat fenders have been disclosed in the patent literature, e.g., U.S. Pat. Nos. 3,183,875 (Russell), 3,498,252 (Peacock) and 3,861,345 (Hull) appear suitable for their intended purposes such bumpers are not suitable as bottles for merchandising or storage applications.

Accordingly, it is a general object of the instant invention to provide a container which is suitable for use as a boat fender and which overcomes the disadvantages of the prior art.

It is a further object of the instant invention to provide a bottle which is suitable for merchandising and storage applications and which forms a viable boat fender.

It is still a further object of this invention to provide a bottle which is simple in construction, low in cost, and which forms an effective and safe boat fender.

It is yet a further of this invention to provide a bottle which forms a boat fender arranged for disposition immediately opposite the gunwale, rub stake or rub rail of a boat.

These and other objects of this invention are achieved by providing a bottle and boat fender. The bottle and boat fender comprise a hollow body for holding a flowable material therein and including a top wall portion having an opening communicating with the interior of the body, closure means releasably secured to said opening, a bottom wall portion and a side wall disposed between the top wall portion and the bottom wall portion and forming the periphery of the body. The side wall includes a pair of opposed wall portions. Each of the wall portions includes a first depression therein. The first depression in one wall portion is aligned with the first depression in the opposed wall portion. The bottom of the aligned opposed depressions form a first common wall therebetween which includes an aperture of sufficient size to accommodate a section of nautical rope therethrough. The aperture is located below the top wall.

Other objects and many of the attendant advantages of this invention will be readily appreciated as the same becomes better understood by reference to the following detailed description when considered in connection with the accompanying drawing wherein.

Figure 1:
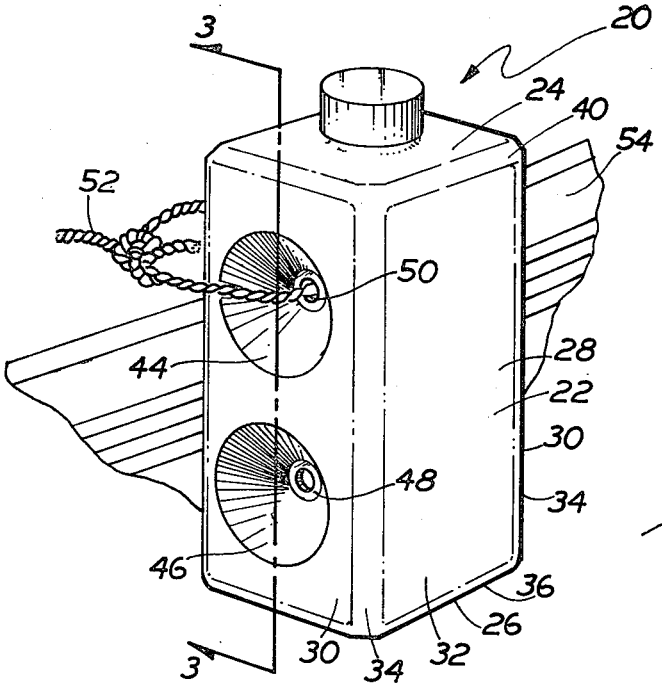
FIG. 1 is a perspective view of the bottle-boat fender of the instant invention shown in an operative position disposed adjacent the gunwale of a boat.

Referring now to the various figures of the drawing wherein like reference characters refer to like parts there is shown generally at 20 in FIG. 1 the bottle-boat fender of the instant invention. The bottle-fender 20, as will be described in detail later, is a hollow member which is suitable for holding flowable materials, e.g., liquids and powders, etc., therein for the merchandising and storage of such materials, while being suitable for use as a boat fender or bumper after such materials have been used up. The bottle-boat fender, when not being used as a fender, is also suitable for use in storing materials e.g. oil, etc. which are normally stored in other containers on a boat, thereby saving valuable space on the boat.

The bottle-fender 20 basically comprises a hollow body 22 having a top wall 24, a bottom wall 26 (FIG. 3) and a side wall 28. The side wall defines the periphery of the body and basically comprises two pairs of opposed planar wall portions 30 and 32. Each planar wall portion 30 extends normally to each planar wall portion 32. The interface of each wall portion 30 and wall portion 32 is in the form of a narrow, angularly extending corner 34.

Figure 3:
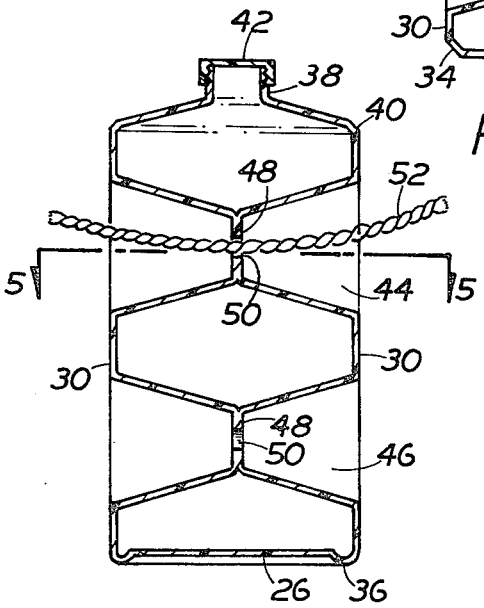
FIG. 3 is a sectional view taken along line 3—3 of FIG. 1.

As can be seen in FIG. 3 the bottom wall 26 is slightly depressed at the central portion thereof to form a peripheral lip 36 at the interface of the bottom wall portion 26 and the side wall 28. The peripherally extending lip 36 serves as the base upon which the bottle-fender 20 is disposed when storing materials therein.

The top wall 24 includes a hollow threaded mouth 38 at the center thereof. The mouth communicates with the hollow interior of the body 22. The top wall 24 extends slightly downward from the base of the mouth to the interface 40 where the top wall joins the side wall 28. A threaded cap 42 is screwed on the mouth to close the mouth and seal the contents in the bottle.

The interior of the body 28 serves as a convenient storage space for liquids, powders or other flowable particulate materials. Accordingly, the bottle-fender 20 serves as a viable container for merchandising various liquid or particulate material products. Once emptied of its contents, the bottle-fender 20 serves as a viable boat fender or bumper to protect the boat from damage caused by impact with other boats or stationary structures.

Figure 5:
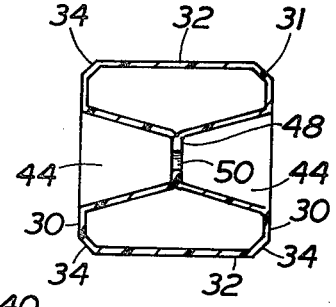
FIG. 5 is a sectional view taken along line 5—5 of FIG. 3.
Figure 4:
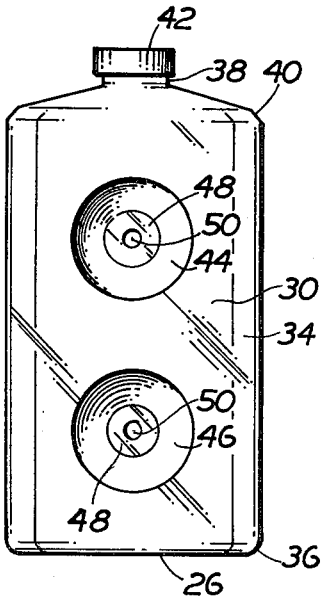
FIG. 4 is a rear elevational view of the bottle-fender shown in FIG. 1.

As shown in FIGS. 1, 3 and 4 each of the opposed planar wall portions 30 includes two depressions 44 and 46. As shown clearly in the sectional view of FIGS. 3 and 5 each of the depressions 44 and 46 is conical in shape tapering downward from the outer surface of the wall portion 30 to the bottom of the depression. The bottom of each depression is identified by the reference numeral 48. As can be seen clearly in FIGS. 3 and 5, the upper depression 44 in one side wall portion 30 is aligned with an identical depression 44 in the opposed side wall, with the bottom portion 48 of the aligned depressions forming a common wall therebetween. A central opening 50 is located in the common wall 48. The opening 50 is provided to receive a boat rope or line therethrough to hang the fender on the boat. To that end the diameter of the opening 50 is just slightly larger than the diameter of typical boat rope or line. The lower depression 48 in one side wall portion 30 is aligned with an identical depression 48 in the opposed side wall portion 30, with the bottom 48 of each depression forming a common wall therebetween. The common wall also includes an opening 50 which is adapted to receive a boat rope therethrough.

In accordance with a preferred aspect of this invention, the depressions are located so that the opposed upper depressions 44, with their central opening 50 therein, lie substantially below the top edge 40 of the fender while the bottom depressions 48, and their central opening 50, lie substantially above the bottom rim 36 of the fender. This feature is of considerable importance since it insures that the fender is disposed immediately opposite the gunwale and not therebelow when it is hung from either opening 50. As will be appreciated by those skilled in the art, if a fender or bumper is not disposed opposite the gunwale but is, in fact, disposed therebelow the boat is susceptible to impact at its gunwale from another boat or from a stationary structure, such as a pier. Both of these conditions are shown in FIG. 2B and identified as prior art.

The bottle-fender 20 of the instant invention is constructed to hang opposite the boats' gunwale and thus provide good reliable protection for the boat and adjacent boats or other structures. To that end operation of the bumper or fender 20 is as follows: A rope or other nautical line 52 is extended through the central opening 50 in either the upper depressions 44 or the lower depressions 46 and the rope is knotted to secure the fender thereon. Water or other ballast is filled into the fender to give it sufficient mass to prevent its flopping about due to boat motion or wind. The fender is then ready to be hung along the gunwale 54 of a boat. To that end, the rope 52 is lashed and tied about a suitable cleat or other support on the boat (not shown) so that one of the fender's flat side wall portions, 32, abuts the gunwale 54. Since the opening 50 through which the rope 52 is extended is located below the top edge 40 or above the bottom edge 36 (depending upon which hole 50 is used) when the bumper is secured in place, the fender remains located opposite the gunwale. This action ensures that the body of the fender is available for impact by another boat or structure.

Figure 2A:
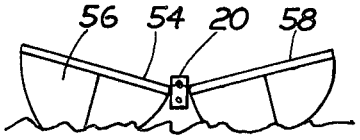
FIG. 2A is a schematic diagram of a pair of boats shown disposed adjacent each other but protected from one another by the bottle-fender of the instant invention.

In FIG. 2A the disposition of the bottle-fender 20 on a boat 56 is shown schematically. As can be seen therein, since the fender 20 is located along the gunwale 54, the boat is not subject to damage or impact from an adjacently moored boat 58. Moreover, the adjacently moored boat 58 is protected from impact by the boat 56.

Figure 2B:
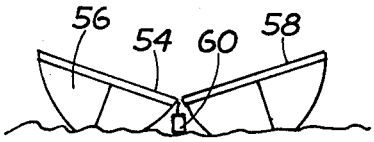
FIG. 2B is a schematic diagram showing prior art boat fenders in operation.
Figure 2B:
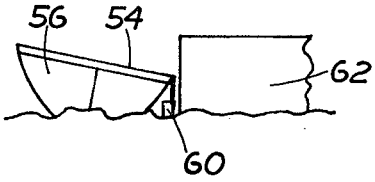

In FIG. 2B a typical prior art bumper 60 is shown hung below the gunwale 54 of a boat 56, in a typical position. This orientation renders the boat 56 susceptible to damage by impacting either adjacent boat 58 or adjacent pier 62.

In accordance with a preferred aspect of this invention the body 22 is formed as an integral unit of a strong, yet lightweight material, such as plastic, although other materials can be used.

It must be pointed out at this juncture that while the bottle-fender is shown as having planar side walls 30 and 32, it is clear that the entire side wall 28 can be circular, oval or any other desired shape, so long as opposed depressions are provided therein, with the opening of the upper pair of depressions being located below the line in which the side wall meets the top wall and with the opening of the lower pair of depressions being located above the line in which the sidewall meets the bottom wall.

As will be appreciated from the foregoing the bottle of the instant invention has considerable appeal as a merchandising premium since it can be used as a container for selling liquids, powders or other flowable material and once the purchaser uses up such material it can then be used as a effective boat fender by merely threading rope through either of the openings provided therein. Moreover, when the bottle-fender is not actually being used as a fender on the boat it can store materials therein which would otherwise be stored in other containers on a boat, thereby saving valuable boat space.

Without further elaboration, the foregoing will so fully illustrate our invention that others may, by applying current or future knowledge, readily adapt the same for use under various conditions of service.

What is claimed as the invention is:

1. A bottle-boat fender comprising a hollow body for holding a flowable material therein and including a top wall portion having an opening communicating with the interior of said body, closure means releasably secured to said opening, a bottom wall portion and a side wall disposed between said top wall portion and said bottom wall portion and forming the periphery of said body, said bottom wall including a planar base portion upon which said bottle-boat fender is disposed for storage of material therein, said side wall including a pair of opposed wall portions, each of said wall portions including a first and a second depression therein, each of said depressions being conically shaped and tapering downward in cross-section towards its bottom, the first depression in one wall portion being aligned with the first depression in the opposed wall portion, the bottom of the aligned opposed depressions forming a first common wall of predetermined area therebetween, said common wall including an aperture of sufficient size to accommodate a section of nautical rope therethrough, but of substantially smaller cross section than the area of said common wall, said first depressions being located below said top wall, the second depression in one wall portion being aligned with the second depression in the opposed wall portion and with the bottom of both depressions formimg a second common wall therebetween, said second depressions being located above said bottom wall portion and being of the same shape as said first depressions.

2. The bottle-boat fender of claim 1 wherein each of said opposed wall portions is planar.

3. The bottle-boat fender of claim 2 wherein said side wall also includes a second pair of opposed wall portions, each of which is planar.

4. The bottle-boat fender of claim 3 wherein said bottle and boat fender is formed of plastic.

5. The bottle-boat fender of claim 4 wherein said closure comprises an internally threaded cap.

* * * * *